US008725037B2

(12) United States Patent
Kawamura

(10) Patent No.: US 8,725,037 B2
(45) Date of Patent: May 13, 2014

(54) IMAGE FORMING APPARATUS

(75) Inventor: Yasunori Kawamura, Osaka (JP)

(73) Assignee: Kyocera Document Solutions Inc. (JP)

( * ) Notice: Subject to any disclaimer, the term of this patent is extended or adjusted under 35 U.S.C. 154(b) by 402 days.

(21) Appl. No.: 13/074,326

(22) Filed: Mar. 29, 2011

(65) Prior Publication Data

US 2011/0243613 A1 Oct. 6, 2011

(30) Foreign Application Priority Data

Mar. 30, 2010 (JP) ..... P2010-079492

(51) Int. Cl.
*G03G 15/08* (2006.01)

(52) U.S. Cl.
CPC ..... *G03G 15/0832* (2013.01); *G03G 2215/068* (2013.01); *G03G 2215/066* (2013.01)
USPC ..... 399/120

(58) Field of Classification Search
CPC ..... G03G 15/08; G03G 2215/066; G03G 2215/0665; G03G 2215/068
USPC ..... 399/107, 102, 111, 27, 13, 120, 113, 399/110, 119
See application file for complete search history.

(56) References Cited

U.S. PATENT DOCUMENTS

| | | | | |
|---|---|---|---|---|
| 5,508,795 | A * | 4/1996 | Kikuchi | 399/27 |
| 5,734,953 | A | 3/1998 | Tatsumi | 399/262 |
| 6,272,299 | B1 * | 8/2001 | Numagami et al. | 399/111 |
| 2008/0181660 | A1 * | 7/2008 | Mase et al. | 399/120 |

FOREIGN PATENT DOCUMENTS

| | | |
|---|---|---|
| JP | 9-106160 | 4/1997 |

* cited by examiner

*Primary Examiner* — Walter L Lindsay, Jr.
*Assistant Examiner* — Matthew Miller
(74) *Attorney, Agent, or Firm* — Ostrolenk Faber LLP

(57) ABSTRACT

An image forming apparatus comprising a detachable container storing a toner, the image forming apparatus comprising: a lever part movable in an attaching and detaching direction of the container, the lever part also contacting the container when the container is being detached, thereby moving the container in a detaching direction; and a stopper part being latched to the container and preventing the container from moving, a latching of the stopper part and the container being unlatched by a movement of the lever part when the container is being detached.

7 Claims, 8 Drawing Sheets

IMAGE FORMING APPARATUS

The present application claims priority on Japanese Patent Application No. 2010-079492, filed Mar. 30, 2010, the content of which is incorporated herein by reference.

BACKGROUND OF THE INVENTION

1. Field of the Invention

The present invention relates to an image forming apparatus.

2. Description of the Related Art

Conventionally, according to an image forming apparatus of copying machines and the like, an imaging device is provided, which performs an imaging so as to enable a viewing of an electrostatic latent image formed on an image supporting body. A toner refilling device is also provided on the imaging device. The toner refilling device comprises a container to refill a toner. The container provided on the toner refilling device is detachably attached. Thus, a configuration is made so that a container that has become empty may be removed and can be replaced with a new container having a full toner. (See Japanese Unexamined Patent Application, First Publication No. H9-106160 (hereinafter referred to as Patent Document 1).)

For example, according to Patent Document 1, the attaching of the container (a "toner bottle" in Patent Document 1) is done by inserting a container, comprising a cylindrical case, along an a shaft center direction with respect to the main body of the apparatus, while, during the final end part of the insertion operation, an insertion is made against a spring provided to a rotation driving part of the container, and an end surface side of the container at an opposite side of the insertion side is latched with a stopper formed with a plate spring. Further, the removing of a container that has become empty is done by pressing the stopper and releasing the engaged condition, utilizing a repulsion force of the spring to make the container pop out, and by pulling out the popped out container.

However, the detaching of the conventional container from the imaging device requires a releasing operation of the stopper. In addition, the container is pulled out by utilizing the repulsion force of the spring. Thus, the operation becomes complex. Moreover, when the repulsion force of the spring becomes small, a section of the container popping out becomes small. In this way, there may be difficulty pulling out the container. Furthermore, when a spring with a strong repulsion force is used, the stress on the container being attached becomes large. As a result, a spring with a strong repulsion force cannot be used. Further, when one tries to pull out the container without using the repulsion force of the spring, a complicated detaching mechanism needs to be provided. As a result, there is a disadvantage in that the equipment becomes too large.

Considering the problems described above, the present invention aims to provide an image forming apparatus which allows a container to be pulled out reliably, and allows a latching of the container and the releasing of the container to be performed reliably.

SUMMARY OF THE INVENTION

In order to achieve the above object, the present invention employs the following.

Namely an image forming apparatus according to an aspect of the present invention includes a detachable container storing a toner. The image forming apparatus includes a lever part movable in an attaching and detaching direction of the container. The lever part also contacts the container when the container is being detached, thereby moving the container in a detaching direction. In addition, the image forming apparatus includes a stopper part being latched to the container and preventing the container from moving. Here, a latching of the stopper part and the container is unlatched by a movement of the lever part when the container is being detached.

EFFECT OF THE INVENTION

According to the present invention, a lever part is configured so as to be able to contact a container. At the same time, a stopper part is configured so as to be able to move. Therefore, although the configuration is simple, a latching of the container may be released and the container may be pulled out reliably by simply moving the lever part in a direction in which the container is attached and removed.

DETAILED DESCRIPTION OF THE PREFERRED EMBODIMENTS

Figure 1A:
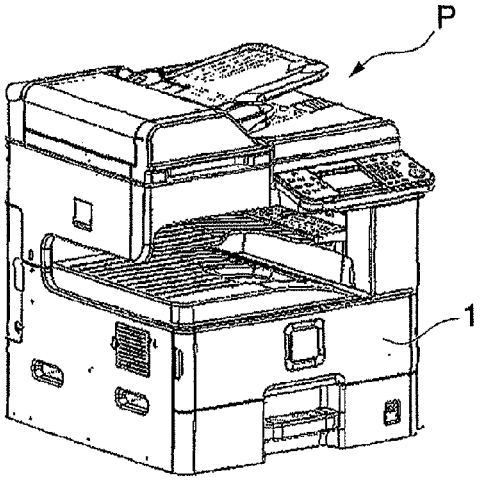
FIG. 1A is a perspective view of a copying machine to which an image forming apparatus according to an embodiment of the present invention is applied.

Hereinafter, an embodiment of an image forming apparatus according to the present invention is described with reference to the attached diagrams. In the drawings referred to below, the scaling of each component is changed as appropriate so that each component becomes a size which may be recognized. Further, in the description below, a copying machine is provided and described as an example of an image forming apparatus according to the present invention.

Figure 1B:
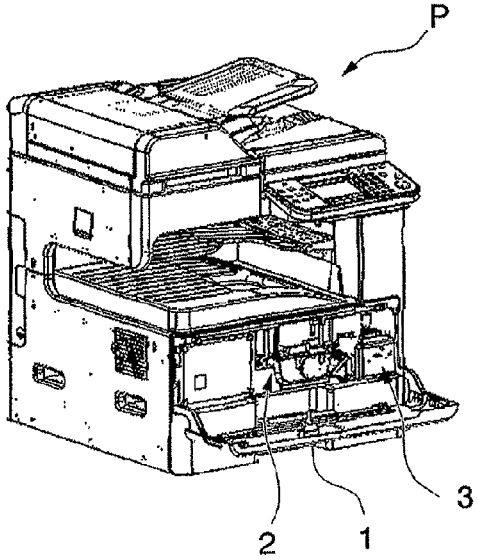
FIG. 1B is a perspective view when a front cover of the copying machine shown in FIG. 1A is opened.
Figure 2:
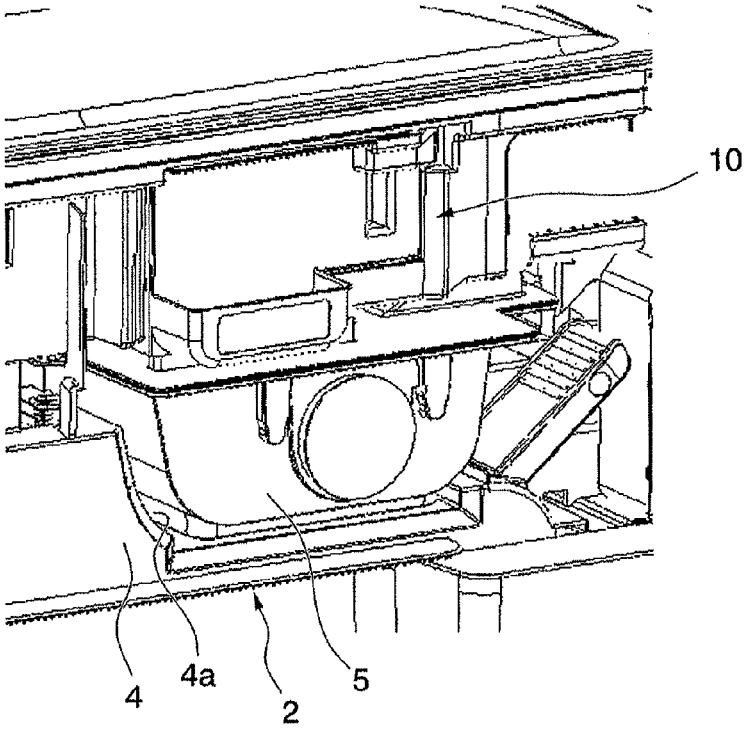
FIG. 2 is a perspective view showing a condition in which a container is attached to a copying machine according to an embodiment of the present invention.

FIG. 1A is a perspective view of a copying machine P comprising a digital photographing system according to the present embodiment. This copying machine P is configured so that, similar to a conventional copying machine, an image of a draft is read, and a printing may be made to a recording paper (recording medium) according to the image data which is read. Further, a front cover 1 is provided at a part of a front surface side, which is a side at which a user of the copying machine P is positioned. A lower side of the front cover 1 is fixed with a hinge, and an upper side of the front cover 1 rotates in a front surface direction. FIG. 1B shows a condition in which the cover 1 is opened when a maintenance inspection is performed on the copying machine P. When this front cover 1 is opened, a configuration is made so that an imaging device 2 inside the copying machine P and a drum unit 3 appear. FIG. 2 provides an enlarged view of the imaging device 2 shown in FIG. 1B.

Figure 3:
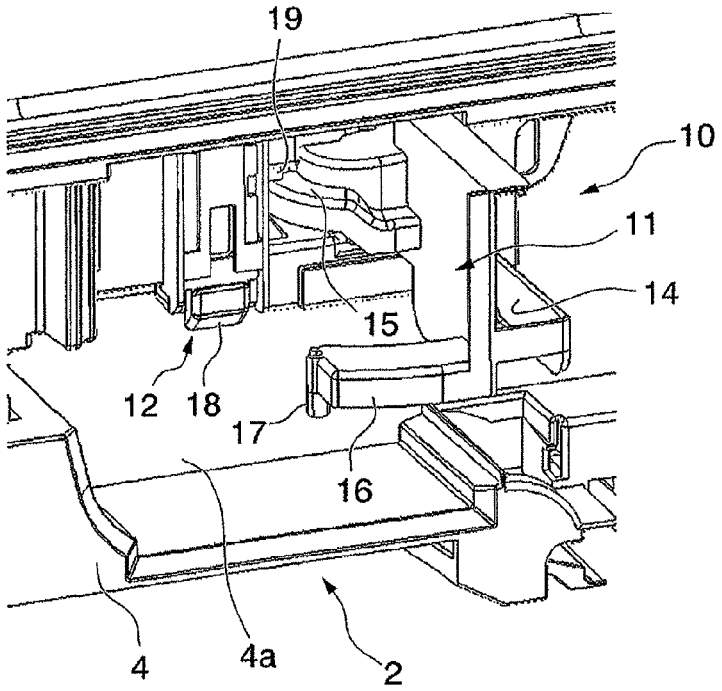
FIG. 3 is a perspective view showing a condition in which a container is detached from a copying machine according to an embodiment of the present invention.

As shown in FIG. 2, the copying machine P comprises a table 4. Described in further detail later on, the table 4 is provided so that the table 4 may move in a width direction of the copying machine P (the left-right direction in FIG. 2) on the frame of the copying machine P. A container storing part 4*a* is provided on the table 4. The container storing part 4*a* is formed by a space extending from a front surface side towards the back. Further, a configuration is made so that a container 5 supplying a toner to the imaging device 2 may be stored in the container storing part 4*a*. Incidentally, FIG. 2 shows a condition in which the container 5 is stored in the container storing part 4*a*. FIG. 3 shows a condition in which the container 5 is pulled out from the container storing part 4*a*.

The container 5 is a cylindrically shaped body comprising an upper wall surface, a bottom wall surface, a front wall surface, and a rear wall surface. The container 5 is configured so that a toner having a predetermined capacity may be stored inside. This container 5 is latched (locked) in a condition so that the container 5 is stored in the container storing part 4*a*. The container 5 is configured so that, if necessary, the locking may be released, and the container 5 may be pulled out from the container storing part 4*a* via a pulling out mechanism 10, pulling out the container to the front side. In other words, the container 5 is provided so that the container 5 may be freely attached to and detached from the container storing part 4*a*. Thus, the container 5 is configured so that a container 5 that has become empty may be removed, and may be replaced with a new container 5 with a full toner. The pulling out mechanism 10 is described later.

The drum unit 3 is configured to comprise an image holding body, i.e., a drum forming an electrostatic latent image. Further, this drum unit 3 is configured so that, at the time of the maintenance inspection, the drum unit 3 may be pulled out in a frontal direction with respect to the copying machine P if necessary.

Figure 5:
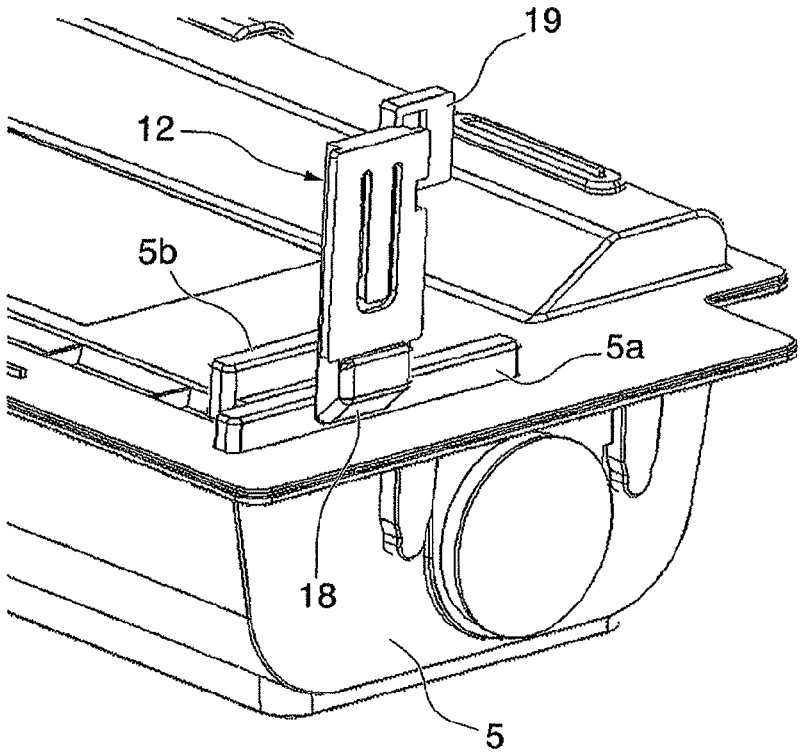
FIG. 5 is a perspective view showing an engaged condition of a stopper part.
Figure 6:
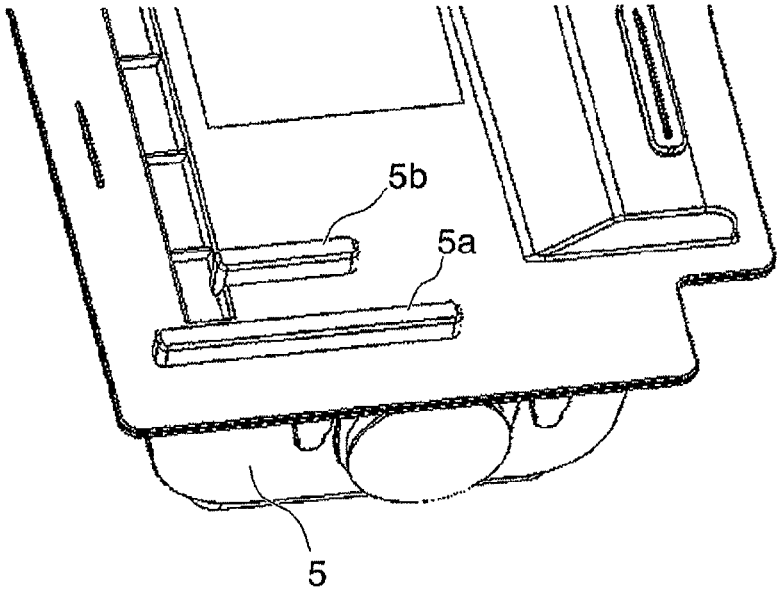
FIG. 6 is a perspective view including a lever part movement prevention part provided on a container.

Hereinafter, the pulling out mechanism 10 according to the present invention is described with reference to FIGS. 4 to 6. This pulling out mechanism 10 comprises a lever part 11 and a stopper part 12.

The lever part 11 may be moved in a direction in which the container 5 is detached or attached. At the same time, when the lever part 11 is detached from the container 5, the lever part 11 comes in contact with the container 5, and moves the container 5 in a detaching direction. This lever part 11 is provided at an upper side of the front surface of the container in a condition in which the container 5 is stored inside the container storing part 4*a*. Further, the lever part 11 is axially supported so that the lever part 11 may rotate freely around a supporting axis 13 provided in the longitudinal direction at a back portion of the drum unit 3 side.

A finger placing part 14 is integrally provided to a lower portion of the front surface of the lever part 11. The finger placing part 14 is large enough so that a plurality of the fingers of the user (i.e., four fingers of the user other than the thumb) may be inserted to the finger placing part 14. Further, a rail 15 is integrally provided at a side of a back surface of the lever part 11, which is also at a side of the supporting axis 13. A rail 15 is configured so that a front surface side of the lever part 11 is low, and the height becomes higher as the distance from the front surface side becomes larger. Further, an arm 16 is integrally provided to a lower portion of the back surface of the lever part 11, which is also at an opposite side of the position of the supporting axis 13. The arm 16 extends by a predetermined distance towards the back. At a lower portion of the tip of the arm 16, a pin 17 extending in the longitudinal direction is provided.

The stopper part 12 is latched to the container 5, and prevents the container 5 from moving. At the same time, when the container 5 is detached, the latching of the stopper part 12 with the container 5 is released due to the movement of the lever part 11. The stopper 12 comprises a long board material extending in the longitudinal direction. Both sides of the stopper 12 is provided to a holder (see FIG. 3 described below) provided on the frame of the copying machine P, so that the stopper may move only in the upper and lower direction. A sloped surface 18 is provided to a tip part of the stopper part 12. The sloped surface 18 is configured so that a section is positioned towards the back as the section is at a lower portion. In addition, a sliding chip 19 is provided at one side of the upper portion (an upper right side in FIG. 4) of the stopper part 12. The sliding chip 19 is placed on the rail 15. This stopper part 12 is placed on the rail 15 via the sliding chip 19, and is supported without being fixed with respect to an upper side.

Figure 4:
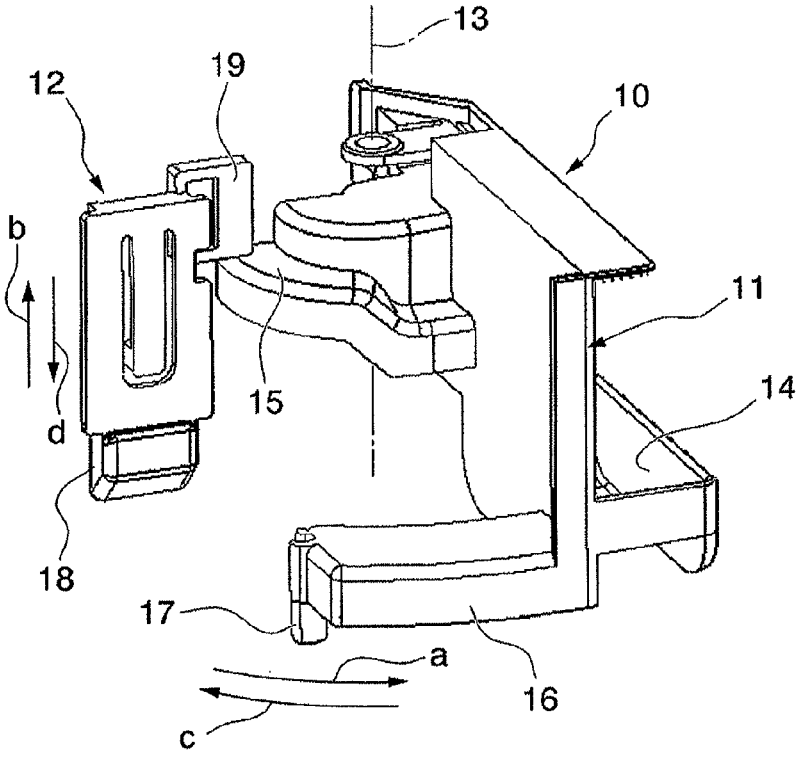
FIG. 4 is a perspective view of a lever part and a stopper part.

Further, according to FIG. 4, when the lever part 11 is moved in the direction of the arrow a, the sliding chip 19 is placed at a high position of the rail 15, and the stopper part 12 is elevated as indicated by the arrow b. Further, when the lever part 11 is moved in the direction of the arrow c, the sliding chip 19 is placed at a low position of the rail 15, and the stopper part 12 descends as indicated by the arrow d. Incidentally, the range of the elevating and descending movement of the stopper part 12 is determined by the height of the protruded setting part 5*a* of a protruding body, described later, which is provided on an upper surface of the container 5. The elevating and descending movement of the stopper part 12 is also determined by the height of the lever part movement prevention part 5*b*. In other words, the elevating and descending movement of the stopper part 12 is determined so that, when the stopper 12 has elevated, the stopper 12 is higher than the upper surface of the protruded setting part 5*a* and the lever part movement prevention part 5*b*, and, when the stopper 12 has descended, the stopper 12 is lower than the upper surface of the protruded setting part 5*a* and the lever part movement prevention part 5*b* (see FIG. 5). Thus, during the movement of the lever part 11, the stopper part 12 is elevated and descended along the rail 15 including the position at which a latching is made with the container 5 and the position at which the latching with the container 5 is released.

The protruded setting part 5*a* and the lever part movement prevention part 5*b* comprise a protruding body, and is provided at an upper surface of a front surface side of the container 5 in a condition in which the container 5 is stored in the container storing part 4*a*. The protruded setting part 5*a* and the lever part movement prevention part 5*b* are positioned so as to be separated by a predetermined distance, and are both parallel to the upper end side of the front surface side of the container 5. Among these, the protruded setting part 5*a* is placed towards the front surface side compared to the lever part movement prevention part 5*b*. At the same time, the protruded setting part 5*a* is configured to be slightly longer than the length of the lever part movement prevention part 5*b* (see FIG. 6).

Figure 7A:
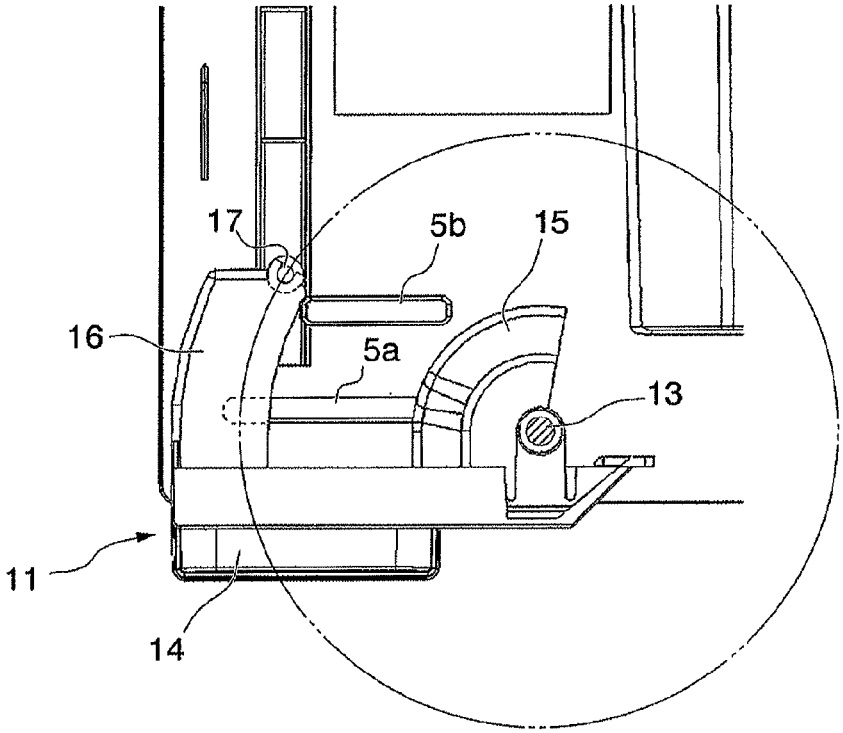
FIG. 7A is a descriptive diagram showing a trajectory of a pin being part of a lever when a container moves towards a drum unit side.
Figure 7B:
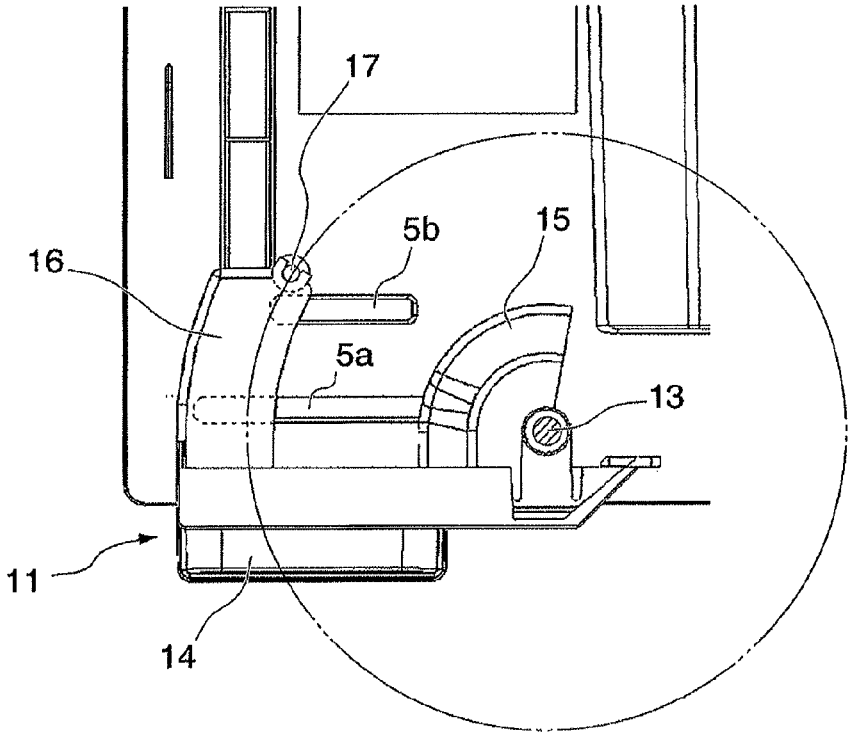
FIG. 7B is a descriptive diagram showing a trajectory of a pin when a container moves from a drum unit side towards a detaching direction.

The positional relationship between the protruded setting part 5*a* and the lever part movement prevention part 5*b* and a pin 17, provided on the arm 16 of the lever part 11, is determined such that, when the table 4 is moving towards the drum unit 3 side, the pin 17 contacts only the protruded setting part 5*a*, as indicated in FIG. 7A, and when the table 4 is moving in a direction separating from the drum unit 3 side, the pin 17 contacts the lever part movement prevention part 5*b*, as indicated in FIG. 7B. Incidentally, the moving mechanism of the table 4 is described later.

Further, the lever part movement prevention part 5*b* prevents the lever part 11 from rotating when the container 5 is moved in a direction different from the detaching and attaching direction and is present at a position such that the container may neither be detached nor attached.

Hereinafter, the pulling out movement of the container 5, which is performed using the pulling out mechanism 10, is described with reference to FIGS. 8A through 8C.

Figure 8A:
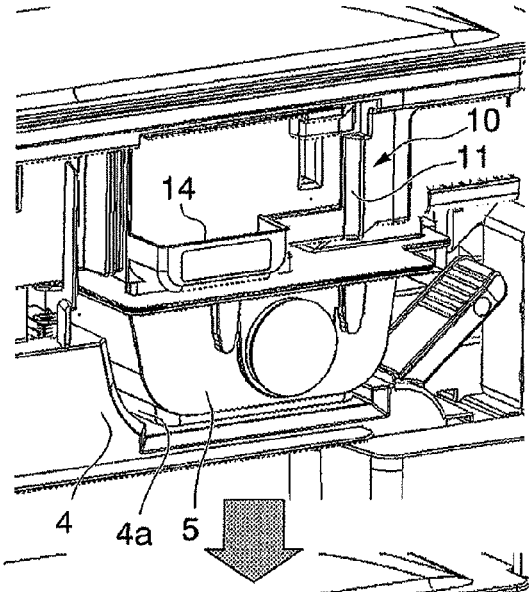
FIG. 8 is a perspective view showing a detaching movement of a container.

FIG. 8A shows a condition in which the container 5 is attached to the container storing unit 4*a*.

Figure 8B:
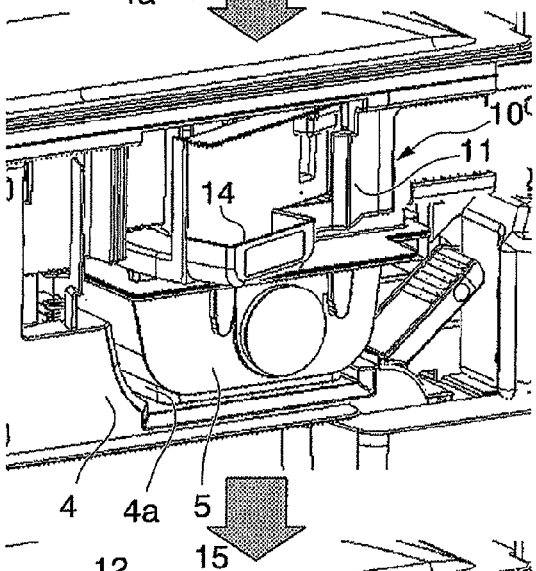

FIG. 8B shows a condition in which the lever part 11 is in the midst of being rotated in the frontal direction by the user's finger being inserted in the finger placing part 14. In this condition, the rail 15 also rotates in accordance with the rotation of the lever 11. Thus, the stopper 12, which is placed on this rail 15, is elevated. (See arrow b in FIG. 4.) Due to the elevation of the stopper 12, the position of the lower end part of the stopper 12 becomes higher than the position of the upper surface of the protruded setting part 5*a*. Thus, the locking condition of the container 5 is released. Further, in accordance with the further rotation of the lever part 11 in a frontal direction, the pin 17 contacts a surface at the opposite side of the front surface side of the protruded setting part 5*a* (the opposite side of the detaching direction), and acts so as to pull out the container 5 from the container storing part 4*a*.

Figure 8C:
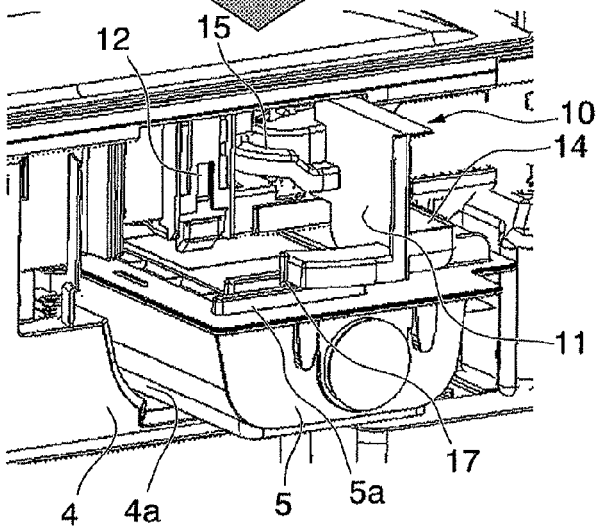

FIG. 8C shows a condition in which the lever part 11 has been rotated by approximately 90 degrees. In this condition, the front surface part side of the container 5 is adequately protruding from the container storing part 4*a*. In this way, even if the pulling out mechanism 10 is not used, it is possible for a user to pull out the container by holding the protruding part.

Therefore, the pulling out mechanism 10 configured as described above is effective in that, when it becomes necessary to pull out the container 5 from the container storing part 4*a* due to the container 5 becoming empty and the like, the locking of the container 5 may be removed and the container 5 may be pulled out at the same time by rotating the lever part 11 once. Therefore, when it is necessary to pull out the container 5, the locking of the container 5 may be removed and the container 5 may be pulled out easily and reliably by inserting a finger in the finger placing part 14 of the lever part 11, and by pulling the finger placing part 14 towards the front side (towards the user).

Figure 9A:
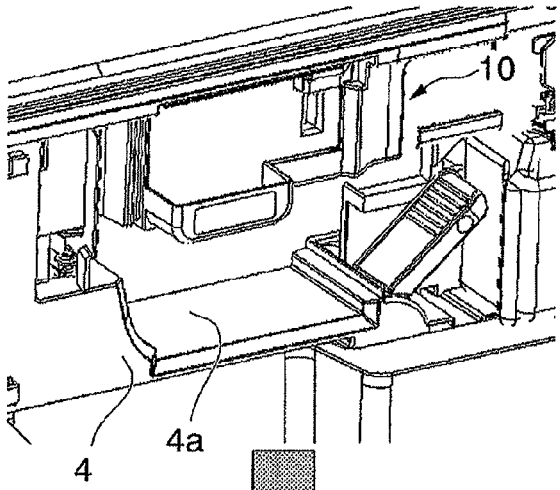
FIG. 9 is a perspective view showing an attaching movement of a container.
Figure 9B:
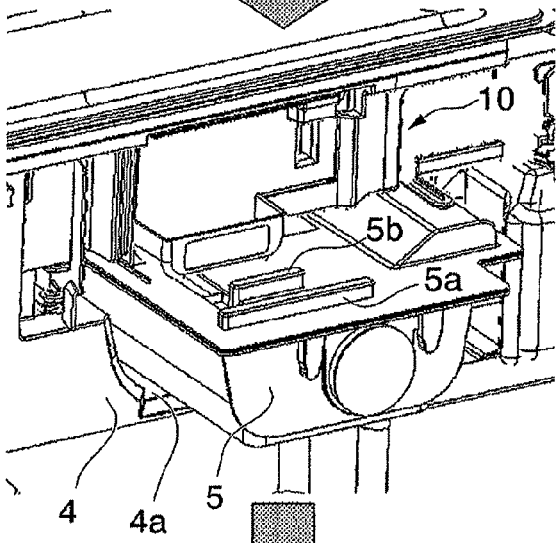
Figure 9C:
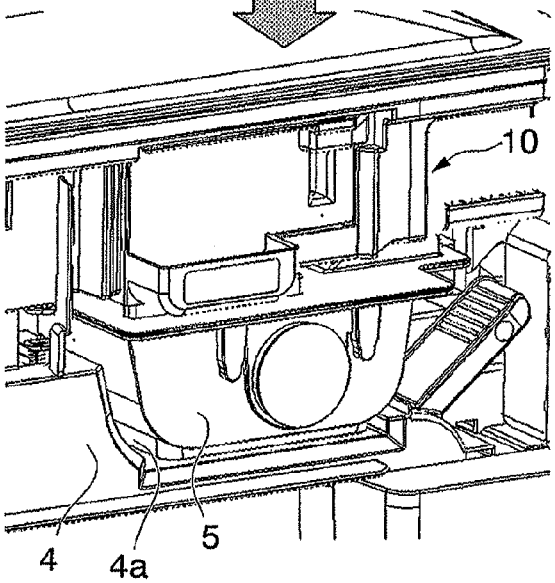
Figure 10:
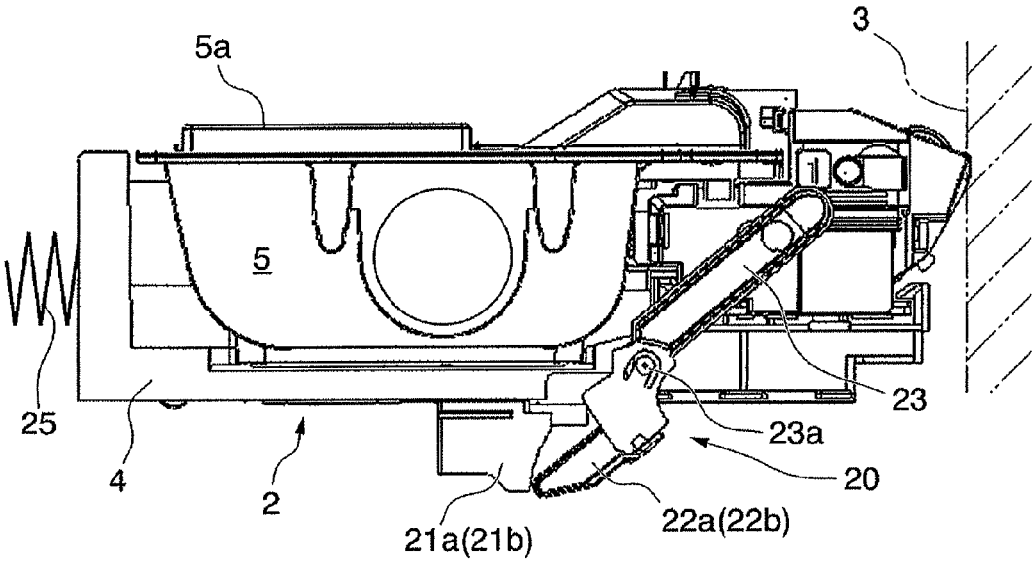
FIG. 10 is a frontal view showing a condition in which a container has moved to a drum unit side.
Figure 11:
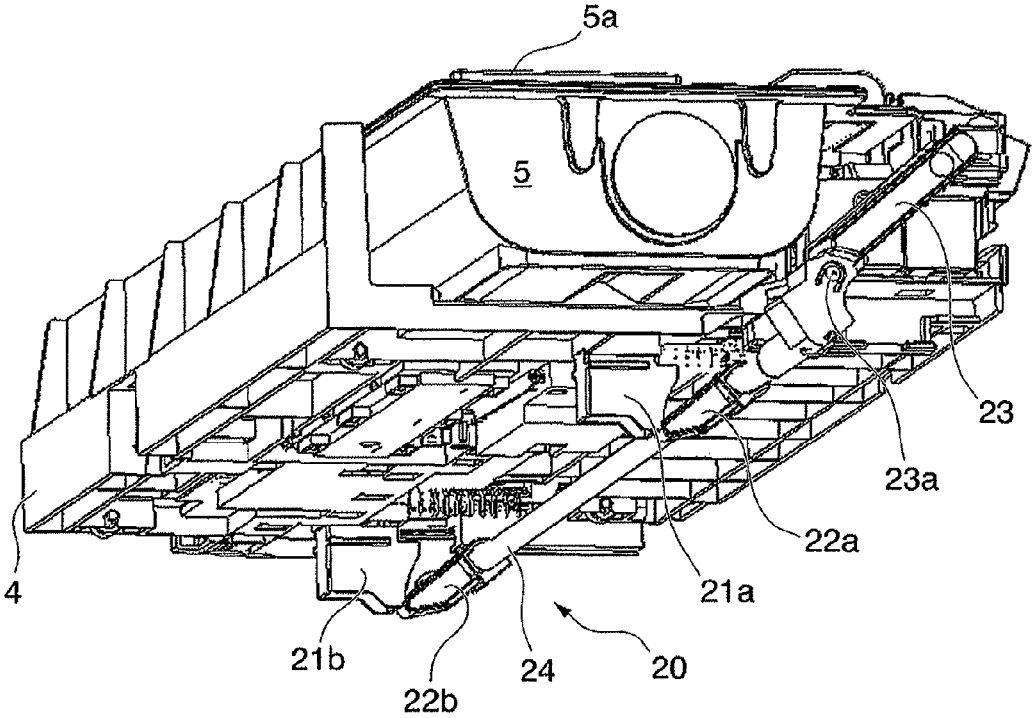
FIG. 11 is a perspective view showing a condition in which a container has moved to a drum unit side.

Next, FIGS. 9A through 9C are used to describe an attaching operation of the container 5 to the container storing part 4*a*.

FIG. 9A shows a condition in which the container 5 is not attached to the container storing part 4*a*.

FIG. 9B shows a condition in which the container 5 is inserted into the container storing part 4*a*.

FIG. 9C shows a condition in which the container 5 is in the midst of being completely inserted into the container storing part 4*a*, and the attaching of the container 5 is in the midst of being completed.

According to the attaching of the container 5, the protruded setting part 5*a* and the lever part movement prevention part 5*b* provided on the upper surface of the container 5 both contact a lower section of the stopper part 12. However, since the sloping surface 18 is provided on the lower section of the stopper part 12, when the stopper part 12 contacts the protruded setting part 5*a* or the lever part movement prevention part 5*b*, it is possible to retreat by pushing up the protruded setting part 5*a* and the lever part movement prevention part 5*b*, thereby preventing any hindrance to the attaching of the container 5.

Further, the lever part 11 contacts the container 5 via the pin 17 from only a direction opposite to the detaching direction of the container 5. Therefore, the lever part 11 will not act as a hindrance to the attaching of the container 5.

Next, the moving mechanism 20 of the table 4 is described using FIGS. 10 through 13.

Normally speaking, one side of the table 4 (in FIG. 10, the right side of the table 4) contacts the drum unit 3. Thus, a configuration is made so that the toner may be provided from the imaging device 2 side to the drum unit 3 without any leakage. However, when it is necessary to take out the drum unit 3 outside of the copying machine P during a maintenance inspection and the like, the drum unit 3 is pulled out towards a front surface side. When the drum unit 3 is pulled out in a condition in which the drum unit 3 is contacting the imaging device 2, the toner not only may dissipate, but the drum unit 3 and the imaging device 2 may be impaired. Therefore, when it is necessary to take the drum unit 3 outside the copying machine P, the table 4 is pulled away from the drum unit 3 using the moving mechanism 20, and thereafter, the drum unit 3 is pulled out.

The moving mechanism 20 comprises a pair of receiving chips 21*a*, 21*b*, a pair of pressing chips 22*a*, 22*b*, and an operation chip 23. The pair of receiving chips 21*a*, 21*b* are provided respectively on the front surface side and its opposite side on the bottom surface of the table 4 while being separated from each other by a predetermined distance. The surface of one side of the receiving chips 21*a*, 21*b* (in FIG. 10, the surface at the right side) is formed to be shaped as a circular arc. Further, the upper end side of the surface of one side of each of the receiving chips 21*a*, 21*b* is formed so as to protrude to one side (in FIG. 10, towards the right side) compared to the lower end side.

The pair of pressing chips 22*a*, 22*b* are provided at a position facing a surface of the pair of receiving chips 21*a*, 21*b* formed to be shaped as a circular arc, and are fixed by an axis 24.

The operation chip 23 comprises a rod material having a predetermined length. An end side of the operation chip 23 is axially supported via a supporting axis 23*a* to a frame of the imaging device 2, not diagrammed, at a position such that the attaching and the detaching of the container is not impeded. Further, an opposite side of this operation chip 23, with the supporting axis 23*a* being the center, is fixed to the axis 24.

Among FIGS. 10 to 13, FIGS. 10 and 11 show a condition in which the table 4 is pressed towards the drum unit 3 side by the spring 25. In this condition, the pair of pressing chips 22*a*, 22*b* contact a lower part of the surface of the pair of receiving chips 21*a*, 21*b* being shaped as a circular arc, and the table 4 is positioned towards the drum unit 3 side.

In this condition, the positional relationship between the protruded setting part 5*a* and the lever part movement prevention part 5*b* and the pin 17 provided at the arm 16 of the lever part 11 is such that, as shown in FIG. 7A, the pin 17 contacts only the protruded setting part 5*a*. Therefore, the locking of the container 5 may be released, and the container 5 may be pulled out by rotating the lever part 11.

Among FIGS. 10 to 13, FIGS. 12 and 13 show a condition in which the table 4 is moved against the spring 25 in a direction separating from the drum unit 3 side. In other words, according to this condition, the operation chip 23 rotates clockwise, with the supporting axis 23*a* being the center. The pressing chips 22*a*, 22*b* contacts the upper part of the receiving chips 21*a*, 21*b*. Further, the table 4 is moved in a direction separating from the drum unit 3 side.

In this condition, since the drum unit 3 is separated from the imaging device 2, the drum unit 3 may be removed without contacting the imaging device 2.

Figure 12:
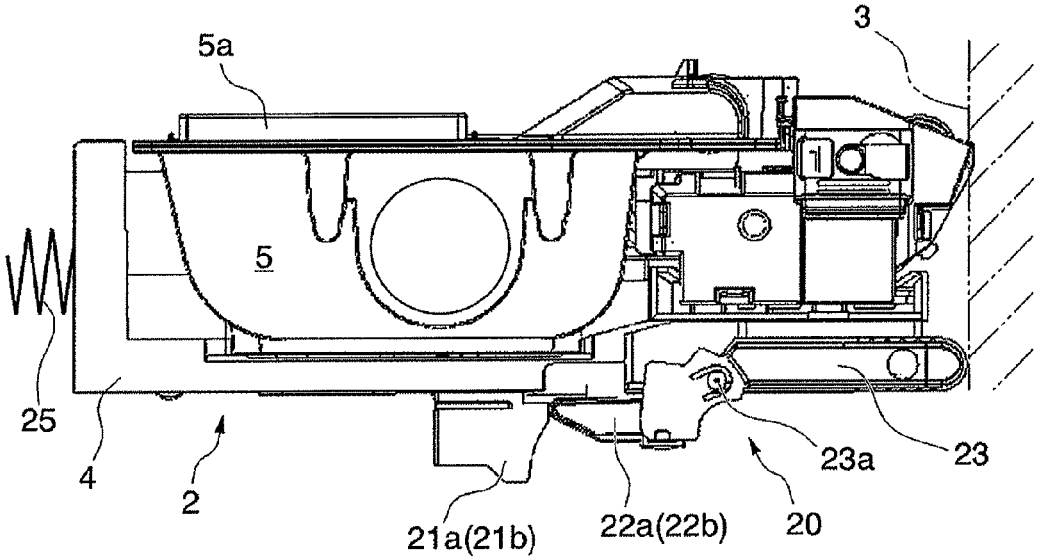
FIG. 12 is a frontal view showing a condition in which a container has moved in a direction moving away from a drum unit side.
Figure 13:
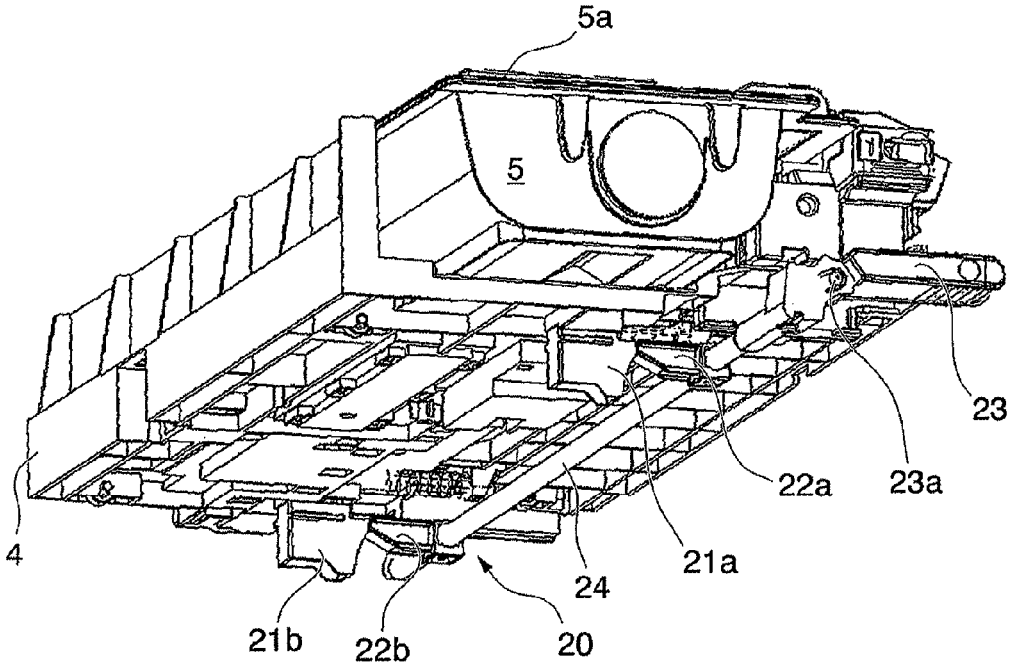
FIG. 13 is a perspective view showing a condition in which a container has moved in a direction moving away from a drum unit side.

Further, in a condition shown in FIGS. 12 and 13, the positional relationship between the protruded setting part 5*a* and the lever part movement prevention part 5*b* and the pin 17 provided at the arm 16 of the lever part 11 is such that, as shown in FIG. 7B, the pin 17 contacts the lever part movement prevention part 5*b*, and the lever part 11 is prevented from rotating. Thus, the stopper part 12 does not elevate. Therefore, the container 5 remains locked. Hence, in this condition, the container 5 is precluded from being pulled out.

When the attaching of the drum unit 3 is completed, the operation chip 23 is rotated counterclockwise, with the supporting axis 23*a* being the center. Moreover, the table 4 is restored to the condition shown in FIGS. 12 and 13.

In this way, concerning the detaching and attaching of the drum unit 3, the moving mechanism 20 configured as described above allows the table 4 to be separated from the drum unit 3 by simply operating the operation chip 23. Therefore, not only may the toner be prevented from being dispersed, but also the drum unit 3 and the imaging device 2 are also prevented from being impaired.

While a preferred embodiment of the present invention has been described above with reference to the attached figures, it should be understood that these are exemplary of the invention and are not to be considered as limiting the present invention. Additions, omissions, substitutions, and other modifications can be made without departing from the scope of the present invention.

For instance, in the above example, an image forming device was considered to be a copying machine. However, the image forming device according to the present invention may be a printer, a facsimile machine, or a combined machine comprising a copier, a printer, and a facsimile device.

The image forming apparatus according to the present invention may be configured as follows: when the lever part moves, the stopper part is provided along a rail provided on the lever part. As a result, the stopper passes through a position at which the container is latched and a position at which the container is unlatched.

In addition, the image forming apparatus according to the present invention may be configured as follows: the lever part contacts the container from only a side opposite to the detaching direction of the container. Further, the stopper is supported without being fixed in an upper direction. In addition, by being pushed up by the container when the container is attached, the stopper is retreatable to a position at which the container is unlatched.

In addition, the image forming apparatus according to the present invention may be configured as follows: the container is movable in a direction different from the detaching direction. Furthermore, when the container is placed at a position at which the container can neither be detached nor attached, a lever part movement prevention part is further provided preventing the lever part from moving.

In addition, the image forming apparatus according to the present invention may be configured as follows: the image forming apparatus further includes on a main body, a developing device provided with a toner contained in the container; and a drum unit comprising an image supporting body supplying the toner from the developing device and forming a toner image. Here, the developing device is held by a supporting member provided movably to the main body. Moreover, the supporting member is movable between a set position and a retreating position. The set position is a position at which the developing device adjacent to the drum unit and the toner image is formed. The retreating position is separated from the drum unit by a predetermined distance. Furthermore, the container is supported by the supporting member so that the container is attachable to the supporting member and detachable from the supporting member.

In addition, the image forming apparatus according to the present invention may be configured as follows: the developing device is positioned to the main body when the supporting member moves to the set position. Meanwhile, the developing device is attachable to the supporting member and detachable from the supporting member when the supporting member moves to the retreating position. Furthermore, the container is attachable to the supporting member and detachable from the supporting member when the supporting member moves to the set position. Meanwhile, an attachability and a detachability of the container to the supporting member are restrained when the supporting member moves to the retreating position.

What is claimed is:

1. An image forming apparatus comprising a detachable container storing a toner, the image forming apparatus comprising:

a lever part movable in an attaching and detaching direction of the container and axially supported so as to rotate freely around an axis provided in a longitudinal direction, the lever part also contacting the container when the container is being detached, thereby moving the container in a detaching direction; and a stopper part being latched to the container and preventing the container from moving, a latching of the stopper part and the container being unlatched by a movement of the lever part when the container is being detached, and the image forming apparatus further comprising on a main body:

a developing device positioned and configured to be provided with a toner contained in the container; and a drum unit comprising an image supporting body positioned and configured to supply the toner from the developing device and forming a toner image, wherein:

the developing device is held by a supporting member provided movably to the main body;

the supporting member is movable between a set position and a retreating position, the set position being a position at which the developing device adjacent to the drum unit and the toner image is formed, and the retreating position being separated from the drum unit by a predetermined distance;

the container is supported by the supporting member so that the container is attachable to the supporting member and detachable from the supporting member;

the container is movable in a different direction from the detaching direction; and further comprising:

a lever part movement prevention part positioned parallel to a width direction of the container, the lever part movement prevention part preventing the lever part from moving, when the container is at a position at which the container is neither detachable nor attachable, wherein the developing device is positioned to the main body when the supporting member moves to the set position, whereas the developing device is attachable to the supporting member and detachable from the supporting member when the supporting member moves to the retreating position; and the container is attachable to the supporting member and detachable from the supporting member when the supporting member moves to the set position, whereas an attachability and a detachability of the container to the supporting member are restrained when the supporting member moves to the retreating position.

2. The image forming apparatus according to claim 1, wherein when the lever part moves, the stopper part is provided along a rail provided on the lever part, thereby the stopper passes through a position at which the container is latched and a position at which the container is unlatched.

3. The image forming apparatus according to claim 1, wherein the lever part contacts the container from only a side opposite to the detaching direction of the container; and the stopper is supported without being fixed in an upper direction, and, by being pushed up by the container when the container is attached, the stopper is retreatable to a position at which the container is unlatched.

4. An image forming apparatus comprising a detachable container storing a toner, the image forming apparatus comprising:

a lever part movable in an attaching and detaching direction of the container, the lever part also contacting the container when the container is being detached, thereby moving the container in a detaching direction; and a stopper part being latched to the container and preventing the container from moving, a latching of the stopper part and the container being unlatched by a movement of the lever part when the container is being detached, and the image forming apparatus further comprising on a main body:

a developing device positioned and configured to be provided with a toner contained in the container; and a drum unit comprising an image supporting body positioned and configured to the toner from the developing device and forming a toner image, wherein:

the developing device is held by a supporting member provided movably to the main body;

the supporting member is movable between a set position and a retreating position, the set position being a position at which the developing device adjacent to the drum unit and the toner image is formed, and the retreating position being separated from the drum unit by a predetermined distance;

the container is supported by the supporting member so that the container is attachable to the supporting member and detachable from the supporting member;

the developing device is positioned to the main body when the supporting member moves to the set position, whereas the developing device is attachable to the supporting member and detachable from the supporting member when the supporting member moves to the retreating position; and the container is attachable to the supporting member and detachable from the supporting member when the supporting member moves to the set position, whereas an attachability and a detachability of the container to the supporting member are restrained when the supporting member moves to the retreating position.

5. The image forming apparatus according to claim 4, further comprising a rail positioned on the lever part, wherein when the lever part moves, the stopper part is provided along the rail such that the stopper part passes through a position at which the container is latched and a position at which the container is unlatched.

6. The image forming apparatus according to claim 4, wherein the lever part contacts the container from only a side opposite to the detaching direction of the container; and the stopper is supported without being fixed in an upper direction, and, by being pushed up by the container when the container is attached, the stopper is retreatable to a position at which the container is unlatched.

7. An image forming apparatus according to claim 4, wherein the container is movable in a direction different from the detaching direction, and further comprising a lever part movement prevention part positioned so as to prevent from moving the lever part when the container is placed at a position at which the container is neither detachable nor attachable.

* * * * *